US007603861B2

(12) United States Patent
Santa Cruz et al.

(10) Patent No.: US 7,603,861 B2
(45) Date of Patent: Oct. 20, 2009

(54) SYSTEM FOR RECUPERATING, INCREASING AND GENERATING ENERGY INHERENT WITHIN A HEAT SOURCE

(76) Inventors: Cathy D. Santa Cruz, 7630 Tholl Dr., Reno, NV (US) 89506; Galen J. May, 7630 Tholl Dr., Reno, NV (US) 89506

( * ) Notice: Subject to any disclaimer, the term of this patent is extended or adjusted under 35 U.S.C. 154(b) by 782 days.

(21) Appl. No.: 11/429,789

(22) Filed: May 8, 2006

(65) Prior Publication Data

US 2007/0256414 A1 Nov. 8, 2007

(51) Int. Cl.
*F01K 25/06* (2006.01)

(52) U.S. Cl. ..... 60/651; 60/671

(58) Field of Classification Search ..... 60/645, 60/651, 671, 659
See application file for complete search history.

(56) References Cited

U.S. PATENT DOCUMENTS 6,182,453 B1 * 2/2001 Forsberg ..... 62/125
6,230,669 B1 * 5/2001 Evans ..... 123/41.5
6,645,652 B2 * 11/2003 Cownden et al. ..... 429/19
6,834,686 B2 * 12/2004 Gray et al. ..... 141/4
6,921,595 B2 * 7/2005 Clawson et al. ..... 429/17
7,055,262 B2 * 6/2006 Goldberg et al. ..... 34/86
7,313,926 B2 * 1/2008 Gurin ..... 62/324.2

* cited by examiner

*Primary Examiner*—Hoang M Nguyen

(57) ABSTRACT

A system that is used for recuperating, increasing and generating energy that is inherent within a heat source. Any type of heat source can be utilized such as "ambient air" which is preferred, or the like. The system incorporates fluids namely, a liquid refrigerant and hot oil. The unusual new end results are accomplished when the liquid refrigerant and hot oil are mixed together resulting in a physical reaction that produces intense (P.S.I.'s) and highly pressurized foam which in turn provides lubrication and produces usable energy that can be used to power the system and/or transferred to a rotary shaft for work. Also, the system may be easily used for refrigeration or air conditioning purposes.

9 Claims, 1 Drawing Sheet

SYSTEM FOR RECUPERATING, INCREASING AND GENERATING ENERGY INHERENT WITHIN A HEAT SOURCE

This invention relates in general to apparatuses and/or methods used for recovering energy inherent within a heat source. However, more particularly pertains to an apparatus that utilizes fluids, namely a liquid refrigerant and hot oil which when combined result in a physical reaction that produces a highly pressurized foam which in turn produces usable energy that can be used to power the system and/or transferred to a rotary shaft for work or the like.

BACKGROUND OF THE INVENTION

Within the known prior art considerable attention has been given to conserving waste heat by converting it into useful work. While a great number of concepts have been proposed to meet this need, they have not until now proven to be practical, efficient and/or cost effective. Such prior art references include U.S. Pat. Nos. 4,266,404, 3,996,745, and 6,195,992 and 6,715,313. Wherein, each apparatus teaches a modification of the "well known" Stirling cycle engine. Many variations of Stirling cycle engines have been conceived but each have inherent drawbacks and disadvantages that the present invention recognizes, addresses and overcomes in a new manner heretofore not taught. For example, these engines use carbon fuels, include numerous components and lots of moving parts, and are limited to operate only at high temperatures, unlike the present invention.

Other types of devices that convert heat into energy include U.S. Pat. Nos. 6,964,176 and 6,334,323. Each of which teach a heat transfer engine having cooling and heating modes of reversible operation. Wherein, the engine includes a rotor structure that is rotatably supported within a stator structure. The stator has primary and secondary heat exchanging chambers in thermal isolation from each other. The rotor has primary and secondary heat transferring portions within which a closed fluid flow circuit is embodied. The closed fluid flow circuit within the rotor has a spiraled fluid-return passageway extending along its rotary shaft, and is charged with a refrigerant that is automatically circulated between the primary and secondary heat transferring portions of the rotor when the rotor is rotated within an optimized angular velocity range under the control of a temperature-responsive system controller.

For more than a century, man has used various techniques for transferring heat between spaced apart locations for both heating and cooling purposes. One major heat transfer technique is based on the reversible adiabatic heat transfer cycle. In essence, this cycle is based on the "well known" principle, in which energy, in the form of heat, can be carried from one location at a first temperature, to another location at a second temperature. This process can be achieved by using the heat energy to change the state of matter of a carrier fluid, such as a refrigerant, from one state to another state in order to absorb the heat energy at the first location, and to release the absorbed heat energy at the second location by transforming the state of the carrier fluid back to its original state. By using the reversible heat transfer cycle, it is possible to construct various types of machines for both heating and/or cooling functions.

Most conventional air conditioning systems in commercial operation use the reversible heat transfer cycle, described above. In general, air conditioning systems transfer heat from one environment (i.e. an indoor room) to another environment (i.e. the outdoors) by cyclically transforming the state of a refrigerant (i.e. working fluid) while it is being circulated throughout the system. Typically, the state transformation of the refrigerant is carried out in accordance with a vapor-compression refrigeration cycle, which is an instance of the more generally known "reversible adiabatic heat transfer cycle".

According to the vapor-compression refrigeration cycle, the refrigerant in its saturated vapor state enters a compressor and undergoes a reversible adiabatic compression. The refrigerant then enters a condenser, wherein heat is liberated to its environment causing the refrigerant to transform into its saturated liquid state while being maintained at a substantially constant pressure. Leaving the condenser in its saturated liquid state, the refrigerant passes through a throttling (i.e. metering) device, wherein the refrigerant undergoes adiabatic throttling. Thereafter, the refrigerant enters the evaporator and absorbs heat from its environment, causing the refrigerant to transform into its vapor state while being maintained at a substantially constant pressure. Consequently, as a liquid or gas, such as air, is passed over the evaporator during the evaporation process, the air is cooled. In practice, the vapor-compression refrigeration cycle deviates from the ideal cycle described above due primarily to the pressure drops associated with refrigeration flow and heat transfer to or from the ambient surroundings.

Although the prior art is functional for cooling and heating purposes they are still not energy efficient and/or they do not produce energy that can be used to power the system and also supply excess energy usable for work.

Still further such systems are much too complicated and include numerous components all of which the present invention eliminates. The present invention not only has been simplified, but also more importantly teaches new technology for converting the heat into usable energy. Namely, when a liquid refrigerant and hot oil are combined result in a physical reaction that produces a highly pressurized foam which in turn produces usable energy that can be used to power the system and/or transferred to a rotary shaft for work.

OBJECTS AND ADVANTAGES OF THE INVENTION

Therefore it is a primary object of the present invention to provide a new and novel system and apparatus for recuperating, increasing and generating energy inherent within a heat source such as from ambient air or the like, that teaches new technology and resolves issues associated with any known prior art.

It is another object of the present invention to provide a new and novel system and apparatus for recuperating, increasing and generating energy inherent within a heat source that is of very simple construction and uses very few moving parts.

Still another object of the present invention to provide a new and novel system and apparatus for recuperating, increasing and generating energy inherent within a heat source that is cost effective, environmentally friendly, and functional for use in any situation wherein power is a concern.

Yet another object of the present invention to provide a new and novel system and apparatus for recuperating, increasing and generating energy inherent within a heat source that requires very little energy upon start-up, is then self energized, and provides excess energy usable for work. However, if an electrical outlet is not available, alternatively the system can be initially energized by a 12-volt battery and a 12-volt starter on the pump(s), or the like.

Still another object of the present invention to provide a new and novel system and apparatus for recuperating, increasing and generating energy inherent within a heat source such as ambient air that eliminates the lubricating problems associated within the prior art as the foam produced provides all of the necessary lubrication.

Another object of the present invention to provide a new and novel system and apparatus for recuperating, increasing and generating energy inherent within a heat source that also may be used for cooling purposes as the system produces cold air that is automatically discharged via an opening in the systems container.

Other objects and advantages will be seen when taken into consideration with the following specification and drawing.

DETAILED DESCRIPTION OF THE DRAWINGS

Figure 1:
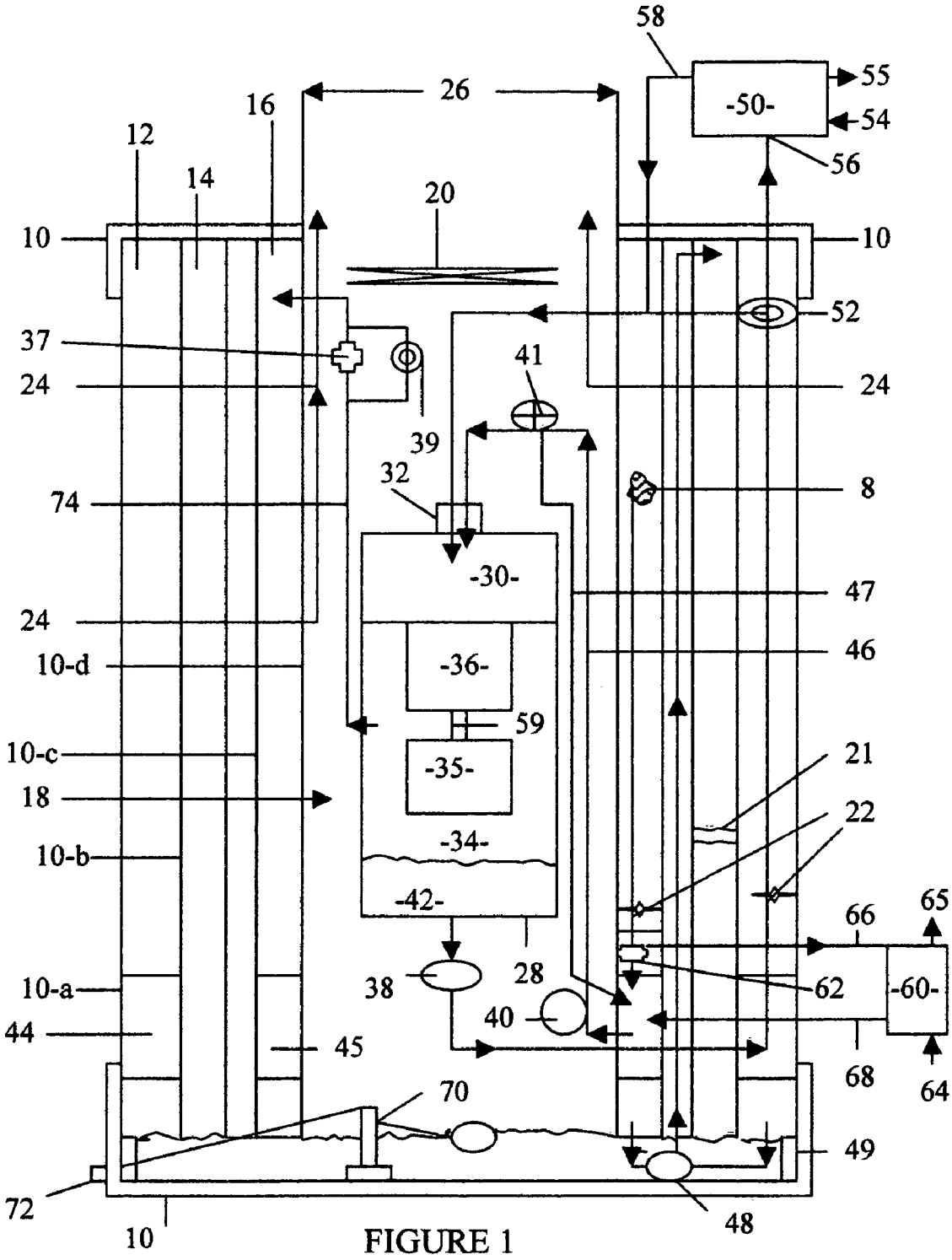
FIG. 1 is substantially a plan over view depicting the internal workings and/or structure for the preferred embodiment of the present invention.

Referring now in detail to the drawing wherein like characters refer to like elements therein. As taught herein the invention is a system for recuperating, increasing and generating energy inherent within a heat source. Depicted in FIG. 1, (10) represents a container for housing the various components of the invention. It is to be noted any suitable type of container of engineering choice may be utilized depending on the needs of the end use and/or workplace. Also the container (10) can be made from any suitable material of choice. However in the preferred embodiment the container (10) is made from stainless steel, aluminum or plastic and is substantially circular in configuration as depicted herein.

The system is initially energized by standard electrical means that of which is not specifically addressed herein, as such electrical means are clearly taught within the prior art and field. Also, it is to be noted any suitable type of heat source may be utilized, such as hot water, exhaust, or the like but in most climates the ambient air is preferred as it is the most efficient, non-polluting, zero cost and economical.

Upon start-up all of the associated components such as pumps, the motor, etc., (later described) are automatically energized. The general overall preferred embodiment is as follows.

A system including the container (10) having an internal compartment that is partitioned forming a first section (10-*a*), a second section (10-*b*), a third section (10-*c*) and a fourth section (10-*d*). The first section (10-*a*) containing a heat exchanger component (12), and it is of any suitable type of choice, such as a finned coil radiator or the like. The second section (10-*b*) containing a standard evaporative cooler component (14), the third section containing a standard condenser component (16) and the fourth section containing a physical reaction system (18) "that is contained within a housing (28)" and a fan (20).

It is to be understood that each section (10-*a* thru 10-*d*) are in open communication with each other via a first air coil arrangement (22) that's associated with the heat exchanger (12), a ventilated fluid recycling membrane (21) that's associated with the evaporative cooler component (14) and a second air coil arrangement (22) that's associated with the condenser component (16), each of which are installed inline within each component (12, 14 & 16). Whereby, each air coil arrangement (22), the ventilated fluid recycling membrane (21) and the fan (20) in combination allow outside ambient air (24) to be drawn into and throughout each component (12, 14 & 16) and then forcibly directed outwardly via fan (20) from within container (10) through an opening (26) located at a position of choice on container (10).

Referring now to the physical reaction system (18) that is located within housing (28). The housing (28) is substantially partitioned forming an evaporator expansion high-pressure chamber (30) and an accumulator compartment (34). The accumulator compartment (34) includes a motor (36) mounted therein. It is to be noted any suitable type of motor of engineering choice may be incorporated, such as a roots blower motor or the like. The motor (36) includes a rotary shaft (59) that is usable for work. Whereby, producing usable excess energy, such as used to operate a generator (35) or the like, or it can be transferred outside of the system by a hydraulic motor/pump, etc.

The evaporator expansion high-pressure chamber (30) is installed inline so as to be in open communication with the motor (36). The evaporator expansion high-pressure chamber (30) further includes an inlet (32) for receiving the fluids therein, namely an oil (42) and a liquid refrigerant (8). As can be seen within the drawing, arrows represent the flow of the fluids, vapor and ambient air.

The new and novel results are achieved upon mixing of the full flow oil (42) and controlled liquid refrigerant (8) within the evaporator expansion high pressure chamber (30), wherein, a physical reaction occurs causing expansion in the form of a foam (not shown) which in turn results in increased pressure/volume. Whereby, due to the increased pressure/volume the foam is automatically forcibly directed into the motor (36), thus providing a compression force for operating the motor (36). Thereafter, upon the foam being ejected from within the motor (36) into the accumulator chamber (34) the foam is then automatically transformed into a vapor/oil and then within the accumulator chamber (34) the vapor is automatically separated allowing the oil (42) to separate back into the original state and accumulate on the bottom of the accumulator chamber (34). Thereafter, the oil is circulated full flow via an oil pump (38) from within the accumulator chamber (34) into and throughout the heat exchanger (12) then further directed into the evaporator expansion high-pressure chamber (30) at its highest temperature, thus completing the oil circulating cycle.

The refrigerant recycling process includes the vapor being directed from within the accumulator chamber (34) into the condenser (16) via a vapor delivery conduit (74), within the condenser (16) the vapor when condensed transforms back into liquid refrigerant (8). Thereafter, within the condenser (16) the liquid refrigerant (8) is directed outwardly there from into and throughout a liquid refrigerant delivery conduit (46) via a refrigerant pump (40) back into the evaporator expansion high-pressure chamber (30), thus completing the refrigerant circulating cycle. It is to be noted that the condenser component (16) has a liquid refrigerant reservoir (45) for containment of reserve liquid refrigerant (8) which is necessary for aiding operation in variable conditions, such as if there is a power surge or the like. An optional feature may be to include within the heat exchanger component (12) an oil reservoir (44) for containment of reserve oil if needed.

The above specification describes the general concept and function. However, further features for enhancing performance and operation include the vapor delivery conduit (74) having a check valve (37) and a compressor (39), both installed therewith. Whereby when the compressor (39) is on the check valve (37) closes and thus the vapor bypasses the check valve (37), and when the compressor (39) is off the vapor is directed into the condenser (16) via the check valve (37). The inclusion of the check valve (37) and the compressor (39) in combination allows for more of the vapor to be delivered to the condenser (16) when operating in marginal temperature conditions, or the like.

Another important feature for the present invention is to include within the refrigerant reservoir (45) a liquid refrigerant return conduit (47) that is interconnected to a refrigerant control valve (41) and the liquid refrigerant delivery conduit (46) is interconnected to the refrigerant control valve (41). Whereby, the liquid refrigerant control valve (41) provides adjustable regulation of how much of the liquid refrigerant (8) is delivered to the evaporator expansion high-pressure chamber (30) or how much of the liquid refrigerant (8) is returned via the liquid refrigerant return conduit (47) to the liquid refrigerant reservoir (45).

Another feature of the present invention is to provide the container (10) with a drip pan (49). Whereby, any accumulating condensed water (resulting from when either of the coils temperature drops below the dew point) from either the heat exchanger component (12) or the condenser (16) drips into the drip pan (49). Whereby, any accumulating condensed water within the drip pan (49) is then directed into a water pump (48) that in return pumps the accumulating condensed water into the evaporator cooler (14). Also, the drip pan (49) includes a standard ball cock (70) and the container (10) has a standard bulkhead fitting (72) for attachment of a water makeup delivery hose (not shown). Whereby, the ball cock (70) and the bulkhead fitting (72) in combination provide automatic fill means for regulating the water level.

It is to be understood the present invention can easily function in environments wherein the ambient air (24) is above freezing without the need for any additional heat. However, certain variables are to be considered, such as different types of refrigerants and oils may require additional heat or cooling.

For example If Puron™ is used, one temperature scenario would be if the outside ambient air is 100 degrees, the air between the heat exchanger (12) and the evaporative cooler (14) would be approximately (80 degrees+/−) and (236 PSI +/− within the oil heating coil), and the air between the evaporative cooler (14) would be around (65 degrees +/−) and (186 PSI +/− within the condenser coil). Whereby, thus resulting in 200 (plus or minus) usable horsepower.

However, depending on the environmental climatic conditions, and/or different refrigerants there may be a need for additional heating or cooling. It is to be noted that use of such additional heating and/or cooling devices maybe either housed within the container or built externally depending on engineering choice.

If additional heat is required the system may further include an auxiliary heat source booster (50) and an auxiliary heat source diverter valve (52). The auxiliary heat source booster (50) has an alternative heat intake (54), an alternative heat outlet (55), an oil inlet (56) and an oil outlet (58) and the said auxiliary heat source diverter valve (52) is installed inline between the heat exchanger component (12) and the auxiliary heat source booster (50). Whereby, when the auxiliary heat source diverter valve (52) is open the oil is directed from within the heat exchanger component (12) via the oil inlet (56) into the auxiliary heat source booster (50) for additional heating. Thereafter, the oil is directed full-flow from within the auxiliary heat source booster (50) via the oil outlet (58) into the evaporator expansion high-pressure chamber (30). Alternatively, when the auxiliary heat source diverter valve (52) is closed, the oil flows full-flow normally back into the evaporator expansion high-pressure chamber (30).

If additional cooling is required, for example if the liquid refrigerant (8) still includes vapor, or is still in vapor form after being circulated through the condenser (16) additional cooling would then be required. Thus, the system may further include an auxiliary cold source booster (60) and an auxiliary cold source control valve (62). The auxiliary cold source booster (60) has an alternative cold intake (64), an alternative cold outlet (65), a liquid refrigerant/vapor inlet (66) and a liquid refrigerant outlet (68). The auxiliary cold source control valve (62) is installed inline between the liquid refrigerant reservoir (45) and the condenser (16). Whereby, when the auxiliary cold source control valve (62) is open the liquid refrigerant/vapor is directed from within the condenser (16) via the liquid refrigerant/vapor inlet (66) into and throughout the auxiliary cold source booster (60) for additional cooling. Thereafter, the liquid refrigerant (8) is directed from within the auxiliary cold source booster (60) via the liquid refrigerant outlet (68) into the liquid refrigerant reservoir (45). However, if the auxiliary cold source control valve (62) is closed the liquid refrigerant (8) is directed onward from within the condenser (16) into the liquid refrigerant reservoir (45).

It is to be noted the liquid refrigerant can be of any suitable type of engineering choice. However, a most suitable type is the newly available Puron™. Also, any suitable oil of engineering choice may be used but any oil must be compatible with the refrigerant of choice, according to factory recommendations.

Other features provided within the system include standard pressure and temperature sensors, and/or a sight glass each located at a position of engineering choice. Although it is to be understood with certain types of refrigerants such as Puron™ a sight glass is not optional, as this would not meet safety recommendations.

It is to be understood any suitable type of auxiliary heat source of engineering choice may be incorporated, including solar heat, etc. Also any suitable type of auxiliary cold source of engineering choice may be incorporated, including well water, a creek, etc. More importantly, the uses for this simple system are much to numerous to list, and is not limited to a specific use. In fact, this system can also be used for spacecrafts such as the Shuttle, satellites, etc. Whereby, the heat from the sun is most appropriate for the heat source and the freezing cold temperature within outer space is most functional for the cooling. Also, if the system is used in this manner only boosters (hot and cold) in the form of panels would be needed thus resulting in elimination of some of the components. However, an additional mechanical centrifugal oil/vapor separator would be needed.

It will further be understood that the system can be of any suitable size, depending on the use or needs at hand.

It will now be seen we herein provided a new technology and system for recuperating, increasing and generating energy inherent within a heat source that heretofore has not been taught. The system is most economical, environmentally friendly as the system produces zero pollutants, is easy to operate and is composed of simple construction with very few moving parts.

Although the invention has been herein shown and described in what is conceived to be the most practical and preferred embodiment, it is recognized that departures may be made there from within the scope and spirit of the invention, which is not to be limited to the details disclosed herein but is to be accorded the full scope of the claims so as to embrace any and all equivalent devices and apparatuses.

Having described our invention, what we claim as new and desire to secure by Letters Patent is:

1. A system for recuperating, increasing and generating energy inherent within a heat source comprising: a container having an internal compartment that is partitioned forming a first section; a second section; a third section; and a fourth section; said first section containing a heat exchanger component, said second section containing an evaporative cooler component, said third section containing a condenser component, said fourth section containing a physical reaction system and a fan, each said section being in open communication with each other via an air coil arrangement associated with said heat exchanger, a ventilated fluid recycling membrane associated with said evaporative cooler component and an air coil arrangement associated with said condenser component each of which are installed inline within each said component, each said air coil arrangement and said ventilated fluid recycling membrane with said fan in combination allow outside ambient air to be drawn into and throughout each said component and forcibly directed outwardly from within said container via an opening located on said container, said physical reaction system including a housing, said housing being partitioned forming an evaporator expansion high pressure chamber and an accumulator compartment, said accumulator compartment having a motor mounted therein, said evaporator expansion high pressure chamber being in open communication with said motor, said evaporator expansion high pressure chamber having an inlet for receiving a hot oil and a liquid refrigerant therein, upon mixing of said hot oil and said liquid refrigerant within said evaporator expansion high pressure chamber a physical reaction occurs causing expansion in the form of a foam which in turn results in increased pressure/volume, due to said increased pressure/volume said foam is forcibly directed into said motor thus providing a compression force for operating said motor, upon said foam being ejected from within said motor into said accumulator chamber said foam is transformed into a vapor, within said accumulator chamber said vapor is separated allowing said oil to separate back into the original state and accumulate on the bottom of said accumulator, said oil is circulated full-flow via an oil pump from within said accumulator chamber throughout said heat exchanger then into said evaporator expansion high pressure chamber thus completing the oil circulating cycle, said vapor is directed from within said accumulator chamber into said condenser via a vapor delivery conduit, within said condenser said vapor when condensed transforms back into said liquid refrigerant, within said condenser said liquid refrigerant is directed outwardly there from through a liquid refrigerant delivery conduit via a refrigerant pump back into said evaporator expansion high pressure chamber thus completing the refrigerant circulating cycle and said motor having a rotary shaft extending there from for performing work.

2. The system for recuperating, increasing and generating energy inherent within a heat source of claim 1 wherein said vapor delivery conduit further includes a check valve and a compressor, whereby when said compressor is on said vapor bypasses said check valve and when said compressor is off said vapor is directed into said condenser via said check valve.

3. The system for recuperating, increasing and generating energy inherent within a heat source of claim 1 wherein said heat exchanger component further includes an oil reservoir for containment of reserve said oil.

4. The system for recuperating, increasing and generating energy inherent within a heat source of claim 1 wherein said condenser component further includes a liquid refrigerant reservoir for containment of reserve said liquid refrigerant.

5. The system for recuperating, increasing and generating energy inherent within a heat source of claim 4 wherein said refrigerant reservoir includes a liquid refrigerant return conduit that is interconnected to a refrigerant control valve, said liquid refrigerant delivery conduit is interconnected to said refrigerant control valve, whereby, said refrigerant control valve provides adjustable regulation of how much of said liquid refrigerant is delivered to said evaporator expansion high pressure chamber or how much of said liquid refrigerant is returned via said liquid refrigerant return conduit to said liquid refrigerant reservoir thus allowing for regulating the horse power of said system.

6. The system for recuperating, increasing and generating energy inherent within a heat source of claim 1 wherein said container includes a drip pan, whereby any accumulating condensed water from either said heat exchanger component or said condenser drips into said drip pan, said any accumulating condensed water within said drip pan is then directed into a water pump that pumps said any accumulating condensed water into said evaporator cooler.

7. The system for recuperating, increasing and generating energy inherent within a heat source of claim 1 further includes an auxiliary heat source booster and an auxiliary heat source diverter valve, said auxiliary heat source booster having an alternative heat intake; an alternative heat outlet; an oil inlet; and an oil outlet; said auxiliary heat source diverter valve being installed inline between said heat exchanger component and said auxiliary heat source booster, whereby when said auxiliary heat source diverter valve is open said oil is directed full-flow from within said heat exchanger component via said oil inlet into said auxiliary heat source booster for additional heating, thereafter said oil is directed full-flow from within said auxiliary heat source booster via said oil outlet into said evaporator expansion high pressure chamber.

8. The system for recuperating, increasing and generating energy inherent within a heat source of claim 4 further includes an auxiliary cold source booster and an auxiliary cold source control valve, said auxiliary cold source booster having an alternative cold intake; an alternative cold outlet; a liquid refrigerant/vapor inlet; and a liquid refrigerant outlet; said auxiliary cold source control valve being installed inline between said condenser and said liquid refrigerant reservoir, whereby when said auxiliary cold source control valve is open said liquid refrigerant is directed from within said condenser via said liquid refrigerant/vapor inlet into and throughout said auxiliary cold source booster for additional cooling, thereafter said liquid refrigerant is directed from within said auxiliary cold source booster via said liquid refrigerant outlet into said liquid refrigerant reservoir.

9. The system for recuperating, increasing and generating energy inherent within a heat source of claim 1 wherein said liquid refrigerant is Puron™ and said oil is synthetic according to factory recommendations or engineering choice.

* * * * *